US008638268B2

(12) United States Patent
Yosui et al.

(10) Patent No.: US 8,638,268 B2
(45) Date of Patent: Jan. 28, 2014

(54) COIL ANTENNA AND ANTENNA STRUCTURE

(75) Inventors: Kuniaki Yosui, Ishikawa-ken (JP); Hiroyuki Kubo, Ishikawa-ken (JP); Hiromitsu Ito, Ishikawa-ken (JP)

(73) Assignee: Murata Manufacturing Co., Ltd., Kyoto-Fu (JP)

( * ) Notice: Subject to any disclaimer, the term of this patent is extended or adjusted under 35 U.S.C. 154(b) by 503 days.

(21) Appl. No.: 12/895,048

(22) Filed: Sep. 30, 2010

(65) Prior Publication Data

US 2012/0081258 A1 Apr. 5, 2012

(51) Int. Cl.
*H01Q 1/00* (2006.01)
*H01Q 7/08* (2006.01)

(52) U.S. Cl.
USPC ..... 343/787; 343/788; 343/866; 343/873; 343/893

(58) Field of Classification Search
None
See application file for complete search history.

(56) References Cited

U.S. PATENT DOCUMENTS

| | | | | |
|---|---|---|---|---|
| 7,000,837 | B2 * | 2/2006 | Akiho et al. | 235/451 |
| 7,050,007 | B2 * | 5/2006 | Akiho et al. | 343/702 |
| 7,280,076 | B2 | 10/2007 | Ninomiya et al. | |
| 7,688,270 | B2 | 3/2010 | Tsushima | |
| 7,712,672 | B2 * | 5/2010 | Takahashi et al. | 235/492 |
| 8,256,684 | B2 * | 9/2012 | Sugita et al. | 235/492 |
| 2010/0309081 | A1 * | 12/2010 | Kobayashi et al. | 343/788 |
| 2012/0098711 | A1 * | 4/2012 | Yosui et al. | 343/702 |
| 2012/0098724 | A1 * | 4/2012 | Yosui et al. | 343/788 |
| 2012/0176283 | A1 * | 7/2012 | Yosui et al. | 343/702 |

FOREIGN PATENT DOCUMENTS

| | | | | |
|---|---|---|---|---|
| CN | 1610923 | A | 4/2005 | |
| CN | 1839515 | A | 9/2006 | |
| CN | 101243581 | A | 8/2008 | |
| CN | 101447603 | A | 6/2009 | |
| EP | 1 477 927 | A1 | 11/2004 | |
| EP | 1477927 | * | 11/2004 | ..... G06K 17/00 |
| EP | 1 484 816 | A1 | 12/2004 | |
| EP | 1 689 028 | A1 | 8/2006 | |
| EP | 1976055 | A1 | 10/2008 | |
| EP | 2 202 843 | A1 | 6/2010 | |
| JP | 2002-325013 | A | 11/2002 | |
| JP | 2002-373319 | A | 12/2002 | |
| JP | 2005-094319 | A | 4/2005 | |

(Continued)

OTHER PUBLICATIONS

Wei Lu; Chinese Office Action; JP20100180738.2; Sep. 25, 2012.
The combined search and examination report from the United Kingdom Intellectual Property Office dated Sep. 10, 2010; GB Application No. GB1008206.3.

(Continued)

*Primary Examiner* — Trinh Dinh
(74) *Attorney, Agent, or Firm* — Studebaker & Brackett PC

(57) ABSTRACT

The disclosure describes a compact coil antenna that can operate even if the coil antenna is arranged closely to its conductor plate, and that has a high degree of coupling with a target antenna. A lower coil conductor part and an upper coil conductor part each have a substantially rectangular and spiral form, and the inner end of the lower coil conductor part connects to the inner end of the upper coil conductor part to be connected in series to the inner end of the upper coil conductor part. In the lower coil conductor part and the upper coil conductor part, the arrangement interval in parallel-to-axis parts including segments that are parallel to the direction of the axis of a magnetic-material core is shorter than the arrangement interval of segments in orthogonal-to-axis parts that are orthogonal to the axis of the magnetic-material core.

9 Claims, 5 Drawing Sheets

(56) References Cited

FOREIGN PATENT DOCUMENTS

| | | | | |
|---|---|---|---|---|
| WO | 2004/029868 A1 | | 4/2004 | |
| WO | 2009/078214 | * | 6/2009 | ..... G06K 19/07 |
| WO | 2009/078214 A1 | | 6/2009 | |

OTHER PUBLICATIONS

The third Office Action issued by the State Intellectual Property Office of People's Republic of China on Jul. 16, 2013, which corresponds to Chinese Patent Application No. 201010180738.2 and is related to U.S. Appl. No. 12/895,048; with translation.

* cited by examiner

COIL ANTENNA AND ANTENNA STRUCTURE

FIELD OF THE INVENTION

The present invention relates to a coil antenna used in, for example, a Radio Frequency Identification (RFID) system that communicates with an external device by using electromagnetic field signals.

BACKGROUND

Coil antennas mounted in mobile electronic devices used in RFID systems are disclosed in, for example, Japanese Unexamined Patent Application Publication No. 2002-325013 (Patent Document 1), Japanese Unexamined Patent Application Publication No. 2002-373319 (Patent Document 2), and Japanese Unexamined Patent Application Publication No. 2005-94319 (Patent Document 3).

FIG. 1 is a top view illustrating the structure of an antenna coil described in Patent Document 1. An antenna coil 30 illustrated in FIG. 1 includes an air core coil 32 and a planar magnetic core member 33. The air core coil 32 is configured by spirally winding conductors 31 (31*a*, 31*b*, 31*e*, and 31*d*) in a plane on a film 32*a*. The magnetic core member 33 is inserted into the air core coil 32 so as to be substantially parallel to a plane of the air core coil 32. The air core coil 32 has an aperture 32*d* and the magnetic core member 33 is inserted into the aperture 32*d*. A first terminal 31*a* is connected to a connecting conductor 31*e* via a through hole 32*b*, and a second terminal 31*b* is connected to the connecting conductor 31*e* via a through hole 32*c*. The magnetic-material antenna is arranged on a conductive plate 34.

In an antenna coil disclosed in Patent Document 2, an antenna magnetic core, which is a planar body, is arranged so as to configure substantially the same plane as the antenna coil while passing through an air core unit of the antenna coil.

In a coil antenna disclosed in Patent Document 3, multiple coils wound on a plane are arranged in multiple layers around the same central axis, the coils on the respective layers are connected in series to each other, and a member of a high permeability is provided between the coils on the respective layers.

In general, the characteristics as a coil antenna are improved and its communication performance is also improved as the number of turns of the coil is increased, the loss of the coil is decreased, and the width of the magnetic core is increased, as long as an inductance necessary for the resonation at a predetermined resonant frequency is achieved. However, there are the following problems in the coil antennas disclosed in Patent Documents 1 to 3.

The antenna coils disclosed in Patent Documents 1 and 2 have the problems in that it is necessary to decrease the width of the magnetic-material core in order to increase the number of turns of the coil, it is not possible to increase the number of turns of the coil when the width of the magnetic-material core is increased, and the loss of the coil is increased when the line width of the coil conductor is decreased to increase the number of turns.

In addition, the antenna coil disclosed in Patent Document 1 has a structure in which the antenna coil is coupled to the magnetic flux parallel to the rear conductive plate 34, as illustrated in FIG. 1. Accordingly, when the antenna coil is mounted in, for example, a mobile phone terminal, there is a problem in that the mobile phone terminal cannot be used with being held over the surface of a reader-writer in parallel if the antenna coil is installed in parallel with a circuit board in the casing of the mobile phone terminal.

In the coil antenna disclosed in Patent Document 3, since the member of a high permeability (a magnetic-material core) is vertically directed, the communication is disabled if the coil antenna is placed on a conductor plate.

SUMMARY

The disclosure is directed to a coil antenna that can operate even if the coil antenna is arranged closely to its conductor plate, and a coil antenna that has a high degree of coupling with a target antenna.

In an embodiment consistent with the claimed invention, a coil antenna includes a flexible substrate having a coil conductor formed thereon and a planar magnetic-material core. Of the coil conductor, the arrangement interval of segments in a part of the coil conductor that is parallel to the axis of the magnetic-material core is shorter than the arrangement interval of segments in a part of the coil conductor that is orthogonal to the axis of the magnetic-material core.

According to a more specific exemplary embodiment, the coil conductor may be composed of multiple layers, and the parts of the respective layers of the coil conductor, which are parallel to the axis of the magnetic-material core, are arranged so as to be superposed on one another.

According to another more specific exemplary embodiment, the coil conductor is formed in a spiral form around a coil conductor opening. The flexible substrate may have an aperture at a position corresponding to the coil conductor opening of the coil conductor. Additionally, the magnetic-material core may pass through the aperture.

According to yet another more specific exemplary embodiment, the coil conductor may be formed in a rectangular spiral form including two parts that are parallel to the axis of the magnetic-material core and two parts that are orthogonal to the axis of the magnetic-material core, and part of either of the two parts of the coil conductor, which are orthogonal to the axis of the magnetic-material core, is covered with the magnetic-material core.

According to another more specific exemplary embodiment, the coil conductor may be formed in a spiral form around a coil conductor opening, and the flexible substrate may be folded in the coil conductor opening of the coil conductor to be arranged so as to wrap the magnetic-material core.

According to another embodiment consistent with the claimed invention, an antenna structure includes a coil antenna having a flexible substrate with a coil conductor formed thereon and a planar magnetic-material core. Of the coil conductor, the arrangement interval of segments in a part of the conductive coil that are parallel to the axis of the magnetic-material core is shorter than the arrangement interval of segments in a in a part of the conductive coil that is orthogonal to the axis of the magnetic-material core. The antenna structure has a planar conductor, and the coil antenna is arranged closely to the planar conductor. A first main face of the magnetic-material core opposes the planar conductor. The coil antenna is arranged toward a side of the planar conductor with respect to the center of the planar conductor. Of the coil conductor, a first conductor part close to the first main face of the magnetic-material core is positioned so as not to be over a second conductor part close to the second main face of the magnetic-material core in view from a line in a direction normal to the first main face or the second main face of the magnetic-material core. A coil axis of the coil conductor is orthogonal to the side of the planar conductor.

According to another more specific exemplary embodiment, the second conductor part is arranged in a position farther from the center of the planar conductor than the first conductor part.

According to another more specific exemplary embodiment, the second conductor part is arranged in a position nearer to the center of the planar conductor than the first conductor part.

DETAILED DESCRIPTION

FIGS. 2A to 2D are diagrams illustrating the structure of a coil antenna according to a first exemplary embodiment.

Figure 1:
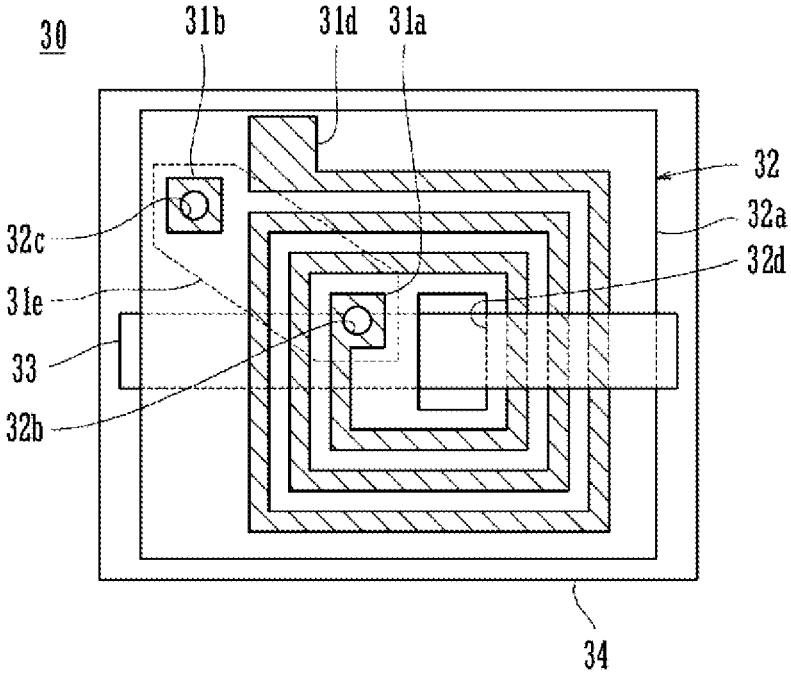
FIG. 1 Prior Art
FIG. 1 is a top view illustrating the structure of a coil antenna described in Patent Document 1.
Figure 2A:
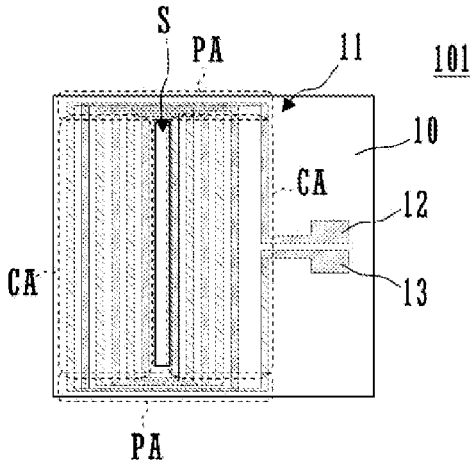
FIG. 2A is a top view diagram illustrating structure of a coil antenna according to a first exemplary embodiment including a flexible substrate.

FIG. 2A is a top view of a flexible substrate 101, which is one component of the coil antenna. The flexible substrate 101 includes a base 10 and a coil conductor 11. The coil conductor 11 is formed on the top face of the base 10.

Figure 2B:
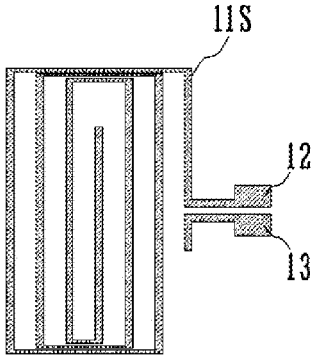
FIG. 2B illustrates the shape of an upper coil conductor part of a coil conductor according to the first exemplary embodiment.
Figure 2C:
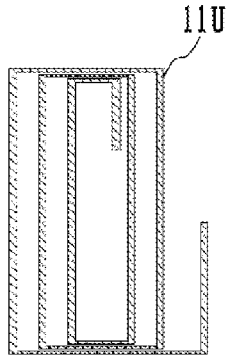
FIG. 2C illustrates the shape of a lower coil conductor part of the coil conductor according to the first exemplary embodiment.
Figure 2D:
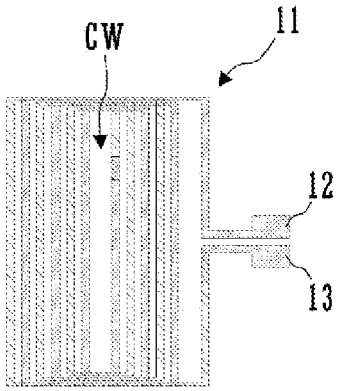
FIG. 2D illustrates a state in which the upper coil conductor part is over the lower coil conductor part according to the first exemplary embodiment.

FIG. 2B illustrates the shape of an upper coil conductor part 11S of the coil conductor 11. FIG. 2C illustrates the shape of a lower coil conductor part 11U of the coil conductor 11. FIG. 2D illustrates a state in which the upper coil conductor part 11S is over the lower coil conductor part 11U.

Each of the lower coil conductor part 11U and the upper coil conductor part 11S has a substantially rectangular and spiral shape, and an insulating layer exists between the lower coil conductor part 11U and the upper coil conductor part 11S. However, the inner end of the lower coil conductor part 11U conducts to the inner end of the upper coil conductor part 11S to be connected in series to the inner end of the upper coil conductor part 11S. In the above manner, the coil conductor 11 is formed in a spiral shape around a coil conductor opening CW.

A terminal electrode 12 connecting to the outer end of the upper coil conductor part 11S is provided on the flexible substrate 101. In addition, a terminal electrode 13 connecting to the outer end of the lower coil conductor part 11U is provided on the flexible substrate 101.

The lower coil conductor part 11U and the upper coil conductor part 11S may be formed on both faces of the base of the flexible substrate, instead of being formed on one side of the base of the flexible substrate with the upper coil conductor part 11S being over the lower coil conductor part 11U.

As illustrated in FIG. 2A, an aperture (slit) S is formed at a position corresponding to the coil conductor opening CW in the base 10 of the flexible substrate 101.

Figure 3A:
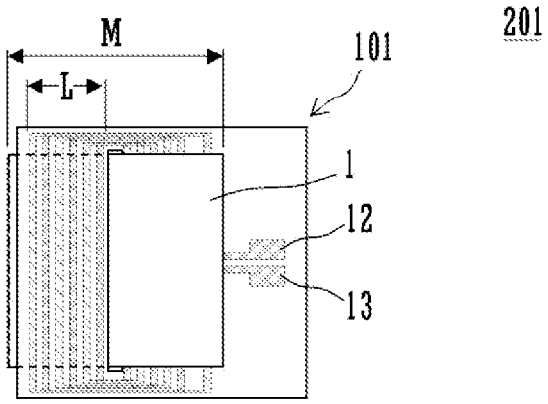
FIG. 3A is a top view of a coil antenna according to an example of the first exemplary embodiment.
Figure 3B:
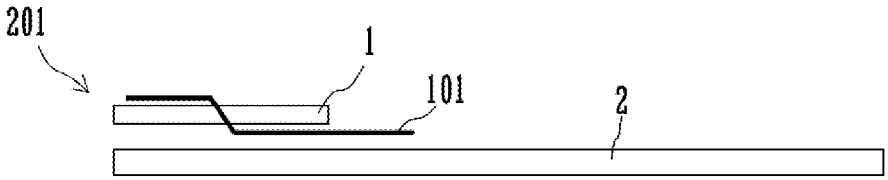
FIG. 3B is a front view of the coil antenna shown in FIG. 3A.

FIG. 3A is a top view of a coil antenna 201. FIG. 3B is a front view of the coil antenna 201.

Figure 3C:
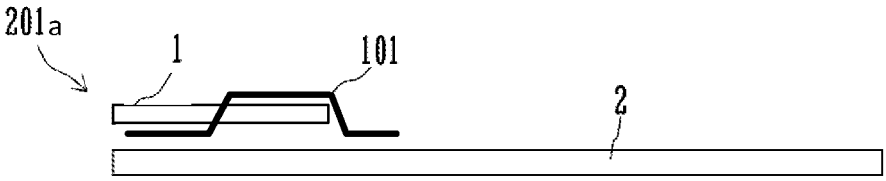
FIG. 3C is a front view of a coil antenna according to another example of the first exemplary embodiment.

A magnetic-material core 1 formed of a rectangular planar ferrite sheet passes through the aperture S of the flexible substrate 101 to compose the coil antenna 201. An antenna apparatus is configured by arranging the coil antenna 201 closely to a planar conductor 2, as shown in FIGS. 3B and 3C. The planar conductor 2 is, for example, a circuit board on which the coil antenna 201 is installed. The coil antenna 201 is arranged such that the face on which the terminal electrodes 12 and 13 illustrated in FIG. 3A are formed opposes the planar conductor 2 (e.g., circuit board).

FIG. 3C shows another example wherein a first main face of the magnetic-material core 1 opposes the planar conductor 2, a flexible substrate 101 includes a first conductor part of the coil conductor 11 (not shown) provided close to the first main face of the magnetic-material core 1 and a second conductor part of the coil conductor 11 provided close to a second main face of the magnetic-material core 1 (shown facing away from the planar conductor). The second conductor part is positioned nearer to the center of the planar conductor than the first conductor part. In such an example, communication performance can be improved in a broad angular range without depending on a positional relationship with a target, to communicate in a longitudinal direction of the planar conductor 2, for example turning the edge of the planar conductor 2 toward the target.

Figure 2E:
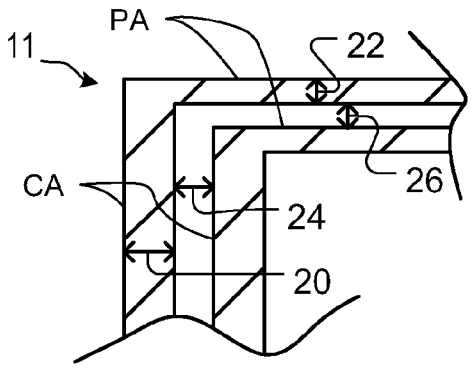
FIG. 2E is an enlarged diagram of a corner portion of coil conductor.

As illustrated in FIG. 2A, in the lower coil conductor part 11U and the upper coil conductor part 11S, the arrangement interval of segments of the coil conductor 11 in parallel-to-axis parts PA that are parallel to the direction of the axis of the magnetic-material core 1 (the lateral direction in the figure) (the direction of the magnetic path) is shorter than the arrangement interval of segments of the coil conductor 11 in orthogonal-to-axis parts CA that are orthogonal to the axis of the magnetic-material core 1. In addition, in this example, the parallel-to-axis parts PA of the upper coil conductor part 115 are arranged so as to be over the parallel-to-axis parts PA of the lower coil conductor part 11U. As can be seen from FIGS. 2A-2D, each turn of the coil conductor 11 has a plurality of opposing parallel-to-axis parts PA that are parallel to a standard axis and a plurality of opposing orthogonal-to-axis parts CA that are orthogonal to the plurality of parallel-to-axis parts PA, a pitch of the plurality of parallel-to-axis parts PA is shorter than a pitch of the plurality of orthogonal-to-axis parts CA, and a width of each of the orthogonal-to-axis parts CA is greater than a width of each of the parallel-to-axis parts PA. FIG. 2E is a diagram of corner portion of coil conductor 11, which is enlarged relative to FIGS. 2A to 2D and shows that a width 20 of an orthogonal-to-axis part CA is greater than a width 22 of a parallel-to-axis part PA and a distance 24 between adjacent orthogonal-to-axis parts CA is greater than a distance 26 between adjacent parallel-to-axis parts PA.

Accordingly, the width of the magnetic-material core can be increased with the same antenna size and the line width of the coil can be increased with the same antenna size, thus further increasing the pitch of the coil pattern.

Next, the results of simulation of the resistance representing the loss of the coil and the coupling coefficient representing the level of the communication performance (the coupling coefficient with a target coil antenna) will be described.

Simulation conditions are as follows:

Each Coil Antenna (1) Coil antenna having a first structure in related art: a coil antenna having a large line width of the coil conductor and a small width of the magnetic core, in which coils parallel to the length of the magnetic core are not superposed on one another. Size of the magnetic-material core: 14 mm×15 mm×0.2 mm. Line width of the coil conductor: 0.1 mm.

(2) Coil antenna having a second structure in the related art: a coil antenna having a small line width of the coil conductor and a large width of the magnetic core, in which coils parallel to the length of the magnetic core are not superposed on one another. Size of the magnetic-material core: 17 mm×15 mm×0.2 mm. Line width of the coil conductor: 0.1 mm.

(3) Coil antenna of the present invention: a coil antenna having a large line width of the coil conductor and a large width of the magnetic core, in which coils parallel to the length of the magnetic-material core are superposed on one another. Size of the magnetic-material core: 17 mm×15 mm×0.2 mm. Line width of the coil conductor: 0.3 mm.

Common items: size of the target coil antenna: 100 mm×100 mm. Distance from the target coil antenna 30 mm. Size of the coil conductor of each coil antenna: 20 mm×15 mm. The number of turns of the coil conductor of each coil antenna: 6.

The relationship between the resistance representing the loss of the coil and the coupling coefficient representing the level of the communication performance is shown in the following Table:

TABLE

| Coil antenna | Resistance [Ω] | Coupling coefficient |
|---|---|---|
| (1) | 1.59 | 2.11% |
| (2) | 2.00 | 2.29% |
| (3) | 1.62 | 2.33% |

In the above manner, it is possible to compose a coil antenna having a high coupling coefficient with the target antenna and a low resistance.

Figure 4:
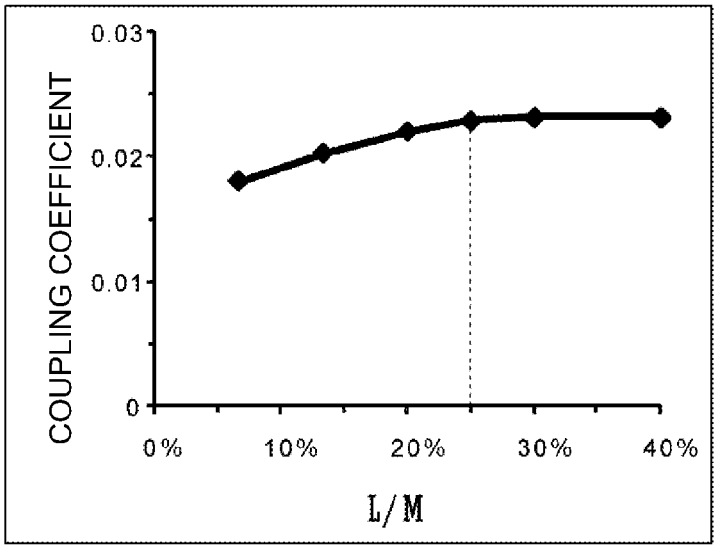
FIG. 4 illustrates the relationship between a coil length and the coupling coefficient.

Next, the relationship between a coil length L (the dimension of the coil in the direction of the axis of the coil in a range in which the coil is wound around the magnetic-material core) and the coupling coefficient is illustrated in FIG. 4. The same simulation conditions as the ones described above are used in this case.

As apparent from FIG. 4, the coupling coefficient reaches the maximum value when the ratio of the length L of the coil with respect to the length M of the magnetic-material core 1 in the direction of the axis exceeds 25%. Accordingly, it is possible to achieve the best communication performance.

Figure 5A:
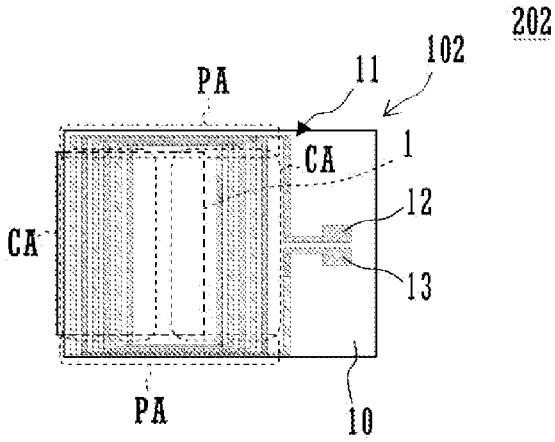
FIG. 5A is a top view of a coil antenna according to a second exemplary embodiment.
Figure 5B:
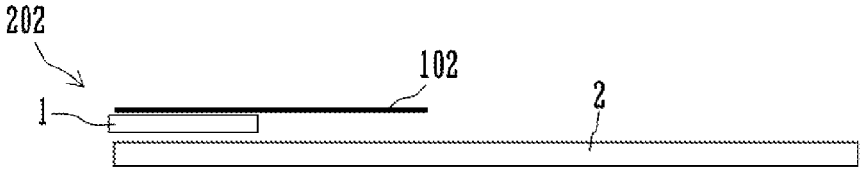
FIG. 5B is a front view of an entire antenna apparatus including the coil antenna shown in FIG. 5A.

FIG. 5A is a top view of a coil antenna 202 according to a second exemplary embodiment. FIG. 5B is a front view of the entire antenna apparatus including the coil antenna 202.

As shown in FIGS. 5A and 5B, a flexible substrate 102 includes the base 10 and the coil conductor 11. The coil conductor 11 is formed on the top face of the base 10.

The coil conductor 11 includes the lower coil conductor part and the upper coil conductor part each having a substantially rectangular and spiral shape, as in the first exemplary embodiment. The coil antenna 202 differs from the coil antenna in the first exemplary embodiment in that the flexible substrate 102 is arranged so as to be over the magnetic-material core 1.

As shown in FIG. 5A, the coil conductor 11 includes the parallel-to-axis parts PA that are parallel to the axis of the magnetic-material core 1 and the orthogonal-to-axis parts CA that are orthogonal to the axis of the magnetic-material core 1. The arrangement interval of coil conductor segments in the parallel-to-axis parts PA is shorter than the arrangement interval of coil conductor segments in the orthogonal-to-axis parts CA. As can be seen from FIG. 5A, each turn of the coil conductor 11 has a plurality of opposing parallel-to-axis parts PA that are parallel to a standard axis and a plurality of opposing orthogonal-to-axis parts CA that are orthogonal to the plurality of parallel-to-axis parts PA, a pitch of the plurality of parallel-to-axis parts PA is shorter than a pitch of the plurality of orthogonal-to-axis parts CA, and a width of each of the orthogonal-to-axis parts CA is greater than a width of each of the parallel-to-axis parts PA. (Also see, FIG. 2E.)

Part of either of the two parallel-to-axis parts PA of the coil conductor 11 is covered with the magnetic-material core 1.

Also with the above structure, it is possible to compose the coil antenna having a high coupling coefficient with a target antenna and a low resistance, as in the first embodiment. In addition, it is possible to compose the compact coil antenna that operates even if the coil antenna is arranged closely to its conductor plate.

Figure 6A:
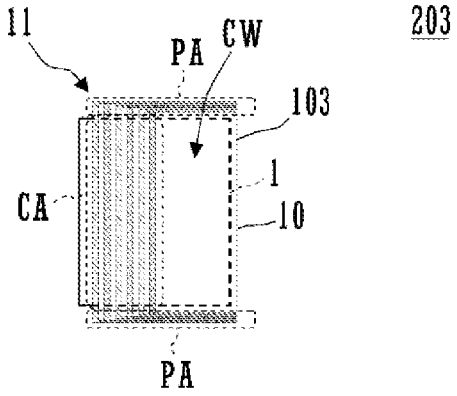
FIG. 6A is a top view of a coil antenna according to a third exemplary embodiment.
Figure 6B:
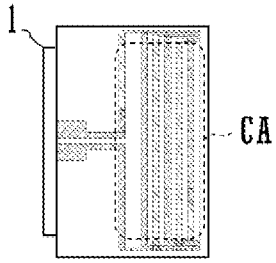
FIG. 6B is a bottom view of the coil antenna shown in FIG. 6A.
Figure 6C:
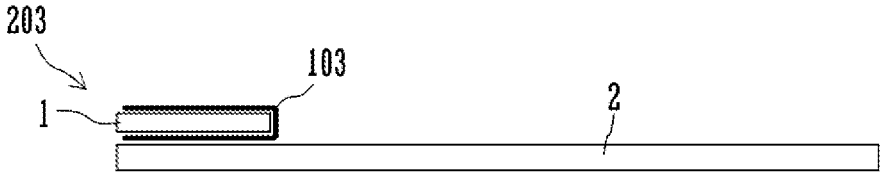
FIG. 6C is a front view of an entire antenna apparatus including the coil antenna shown in FIGS. 6A and 6B.

FIG. 6A is a top view of a coil antenna 203 according to a third exemplary embodiment. FIG. 6B is a bottom view of the coil antenna 203. FIG. 6C is a front view of the entire antenna apparatus including the coil antenna 203.

The coil antenna 203 includes a flexible substrate 103 having a base 10 and a coil conductor 11. The coil conductor 11 is formed on one surface of the base 10.

The coil conductor 11 includes the lower coil conductor part and the upper coil conductor part each having a substantially rectangular and spiral shape, as in the first and second exemplary embodiments. The coil antenna 203 differs from the coil antenna in the second exemplary embodiment in that the flexible substrate 103 is folded to wrap the magnetic-material core 1. As shown in FIGS. 6A and 6B, the flexible substrate 103 wraps around three faces of the magnetic-material core 1.

The coil conductor 11 includes parallel-to-axis parts PA that are parallel to the axis of the magnetic-material core 1 and orthogonal-to-axis parts CA that are orthogonal to the axis of the magnetic-material core 1. As can be seen from FIGS. 6A and 6B, each turn of the coil conductor 11 has a plurality of opposing parallel-to-axis parts PA that are parallel to a standard axis and a plurality of opposing orthogonal-to-axis parts CA that are orthogonal to the plurality of parallel-to-axis parts PA, a pitch of the plurality of parallel-to-axis parts PA is shorter than a pitch of the plurality of orthogonal-to-axis parts CA, and a width of each of the orthogonal-to-axis parts CA is greater than a width of each of the parallel-to-axis parts PA. (Also see, FIG. 2E.)

The flexible substrate 103 is folded along a line through the coil conductor opening CW of the coil conductor 11 to be arranged so as to wrap the magnetic-material core 1. Also with the above structure, it is possible to compose the coil antenna having a high coupling coefficient with a target antenna and a low resistance, as in the first and second exemplary embodiments. In addition, it is possible to compose the compact coil antenna that operates even if the coil antenna is arranged closely to its conductor plate.

Embodiments consistent with the claimed invention can facilitate provision of the following advantages:

A) The coil antenna can operate and can communicate even if the coil antenna is arranged closely to a conductor plate.

B) Since the width of the magnetic-material core can be increased with the same antenna size, the amount of magnetic flux through the magnetic-material core can be increased to improve the communication performance.

C) Since the line width of the coil can be increased with the same antenna size, the loss of the coil can be reduced to improve the communication performance.

D) Increasing the pitch of the coil pattern can allow the coupling coefficient with a target antenna coil to be increased, thus improving the communication performance.

While exemplary embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. A coil antenna comprising a magnetic-material core and a coil conductor adjacent the magnetic-material core, wherein the coil conductor comprises a plurality of turns of coil conductor pattern, each said turn having a plurality of opposing parallel-to-axis parts that are parallel to a standard axis and a plurality of opposing orthogonal-to-axis parts that are orthogonal to the plurality of parallel-to-axis parts, when viewed in planer view, the magnetic-material core is arranged so as to overlap with at least a part of the orthogonal-to-axis part, a pitch of the plurality of parallel-to-axis parts is shorter than a pitch of the plurality of orthogonal-to-axis parts, a width of each orthogonal-to-axis part is greater than a width of each parallel-to-axis part, and the direction of the standard axis is a direction of the main magnetic flux generated in the magnetic-material core by a current flowing in the coil conductor.

2. The coil antenna according to claim 1, wherein the coil conductor is composed of multiple layers, and the plurality of parallel-to-axis parts are arranged so as to be superposed on one another.

3. The coil antenna according to claim 2, wherein the coil conductor is formed on a flexible substrate, the coil conductor being formed in a spiral form around a coil conductor opening, the flexible substrate has an aperture at a position corresponding to the coil conductor opening of the coil conductor, and the magnetic-material core passes through the aperture.

4. The coil antenna according to claim 2, wherein the coil conductor pattern is formed in a rectangular spiral form including two orthogonal-to-axis parts arranged parallel to one another, and part of either of the two orthogonal-to-axis parts is covered with the magnetic-material core.

5. The coil antenna according to claim 2, wherein the coil conductor is formed on a flexible substrate, the coil conductor being formed in a spiral form around a coil conductor opening, and the flexible substrate is folded in the coil conductor opening of the coil conductor to be arranged so as to wrap the magnetic-material core.

6. The coil antenna according to claim 1, wherein the coil conductor is formed on a flexible substrate, the coil conductor being formed in a spiral form around a coil conductor opening, the flexible substrate has an aperture at a position corresponding to the coil conductor opening of the coil conductor, and the magnetic-material core passes through the aperture.

7. The coil antenna according to claim 1, wherein the coil conductor pattern is formed in a rectangular spiral form including two orthogonal-to-axis parts arranged parallel to one another, and part of either of the two orthogonal-to-axis parts is covered with the magnetic-material core.

8. The coil antenna according to claim 1, wherein the coil conductor is formed on a flexible substrate, the coil conductor being formed in a spiral form around a coil conductor opening, and the flexible substrate is folded in the coil conductor opening of the coil conductor to be arranged so as to wrap the magnetic-material core.

9. The coil antenna according to claim 1, wherein a distance between adjacent ones of the orthogonal-to-axis parts is longer than a distance between adjacent ones of the parallel-to axis parts.

* * * * *